US007174864B2

(12) United States Patent
Loschiavo

(10) Patent No.: US 7,174,864 B2
(45) Date of Patent: Feb. 13, 2007

(54) COMBUSTION ENGINE

(75) Inventor: Vincent Loschiavo, Moorabbin (AU)

(73) Assignee: Pulse Linear Developments Pty Ltd, Melbourne (AU)

( * ) Notice: Subject to any disclaimer, the term of this patent is extended or adjusted under 35 U.S.C. 154(b) by 0 days.

(21) Appl. No.: 10/533,167

(22) PCT Filed: Oct. 31, 2002

(86) PCT No.: PCT/AU02/01467

§ 371 (c)(1),
(2), (4) Date: Apr. 29, 2005

(87) PCT Pub. No.: WO2004/040107

PCT Pub. Date: May 13, 2004

(65) Prior Publication Data

US 2006/0042576 A1 Mar. 2, 2006

(51) Int. Cl.
*F02B 75/18* (2006.01)
*F02B 75/32* (2006.01)

(52) U.S. Cl. ..... 123/56.2; 123/57.1

(58) Field of Classification Search ..... 123/56.1, 123/56.2, 57.1, 197.1, 197.4
See application file for complete search history.

(56) References Cited

U.S. PATENT DOCUMENTS 2,401,466 A 6/1946 Davis et al.
3,757,748 A * 9/1973 Arney ..... 123/45 A
5,218,933 A 6/1993 Ehrlich
6,098,578 A 8/2000 Schuko

FOREIGN PATENT DOCUMENTS

AU 58127 A 8/1986
AU 48826 A 3/1990

* cited by examiner

*Primary Examiner*—Noah P. Kamen
(74) *Attorney, Agent, or Firm*—Kirk Hahn

(57) ABSTRACT

A combustion engine comprising; a pair of opposed cylinder elements (2, 3) having a common axis, each cylinder element being provided with a piston (28) reciprocable between first and second locations in the cylinder element the first and second locations respectively representing compression and expansion elements of the piston stroke, each piston having a forward side and a rear side; a combustion chamber (38) for each cylinder element comprising the forward side of the piston (28) and the walls (2) of the cylinder element; combustible gas compression means (37*b*, 37*c*) for each combustion chamber; supply passage means (41) arranged to deliver combustible gas to each combustible gas compression means; an induction chamber (37*a*) for each piston arranged to receive compressed combustible gas from the combustible gas compression means; transfer passage means (39) for directing compressed gas from each induction chamber to the respective combustion chamber, and cam means (13) rotatable about the common axis the cam means being located between the pistons and being connected to each of the pistons for converting the reciprocating motion of the pistons into rotary motion of the cam means; wherein the arrangement is such that expansion stroke movement of each piston results in a corresponding compression stroke for the compression means and the pistons are coupled so that an expansion stroke of one of the pistons drives the compression stroke of the other of the pistons.

22 Claims, 1 Drawing Sheet

COMBUSTION ENGINE

This application is the U.S. National Phase under 35 U.S.C. §371 of International Application PCT/AU2002/001467, filed on Oct. 31, 2002. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

FIELD OF THE INVENTION

This invention relates to an internal combustion engine. In a particular non-limiting aspect, it relates to a self-super charging 2-stroke internal combustion engine.

BACKGROUND OF THE INVENTION

A combination of the world energy crisis and a realisation that greenhouse gases could present a threat to the environment has led to the need for the development of combustion motors which are energy efficient.

Energy efficiency can be achieved in two basic ways. The first of these ways is the obvious one of converting combustion energy efficiently to mechanical energy. A less obvious way is to reduce the weight of combustion engines used to drive vehicles. The weight of the engine is a significant proportion of the overall weight of the vehicle. As fuel consumption is directly related to the vehicle weight, a lighter engine automatically leads to a lighter vehicle and hence reduced fuel consumption.

Thus, in order to maximise energy efficiency, there is a need for the development of engine designs which combine energy efficiency in converting combustion energy to mechanical energy with light weight.

DISCLOSURE OF THE INVENTION

The invention provides a combustion engine comprising, a pair of opposed cylinder elements having a common axis, each cylinder element being provided with a piston reciprocable between first and second locations in the cylinder element the first and second locations respectively representing compression and expansion elements of the piston stroke, each piston having a forward side and a rear side, a combustion chamber for each cylinder element comprising the forward side of the piston and the walls of the cylinder element, combustible gas compression means for each combustion chamber, supply passage means arranged to deliver combustible gas to each combustible gas compression means, an induction chamber for each piston arranged to receive compressed combustible gas from the combustible gas compression means, transfer passage means for directing compressed gas from each induction chamber to the respective combustion chamber, and cam means rotatable about the common axis the cam means being located between the pistons and being connected to each of the pistons for converting the reciprocating motion of the pistons into rotary motion of the cam means, wherein the arrangement is such that expansion stroke movement of each piston results in a corresponding compression stroke for the compression means and the pistons are coupled so that an expansion stroke of one of the pistons drives the compression stroke of the other of the pistons.

Suitably the cam means comprises a drive shaft. The drive shaft may have a cam track encircling the drive shaft. The cam track may be designed to maximise the combustion efficiency of the engine. It may typically follow a sinusoidal path. A cam follower connected to both of the pistons may be arranged to follow the cam track and to convert the reciprocating motion of the pistons into rotary motion of the drive shaft. The cam track is suitably a groove formed in the drive shaft.

The drive shaft may extend through a bore assembly provided in association with each piston. The bore assembly may extend through each piston in line with the axis of each piston. The bore assembly may include at least part of the transfer passage means. The transfer passage means may include a transfer port for each piston arranged to communicate with the combustion chamber for that piston. It may be arranged so that communication occurs when the piston is at or near the second location so as to allow combustible gas under pressure to flow from the induction chamber into the combustion chamber when the piston is about to commence its compression stroke.

Valve means are suitably provided in association with the transfer port. The valve means may be designed to close the transfer port during exhaustion of combusted gases from the combustion chamber and to open the transfer port after exhaustion of combustion chambers from the combustion chamber has been completed at the end of the expansion stroke. The valve means may be attached to the drive shaft and hence may be operable by rotation of the drive shaft.

An exhaust passage is suitably provided in communication with the combustion chamber in a position where the piston closes off the exhaust passage until it is near the end of each expansion stroke.

The cam follower may be attached to an intermediate assembly. Hence the intermediate assembly may extend between the pistons and may connect the rear side of each piston. Thus, the intermediate assembly may be slidably reciprocable with respect to the drive shaft.

The combustible gas compression means may comprise two compression chambers associated with each piston. The first compression chamber for each piston may be provided between the end of the intermediate assembly and a piston sealing member. The piston sealing member may comprise an annular member which is held fixed in a housing containing the cylinder elements. It may surround a centre housing which in turn surrounds the drive shaft. It may be arranged so that it is sealingly slidable within the outer skirt of a piston.

The second compression chamber for each piston may be defined between the forward side of the piston and the piston sealing member.

Intermediate ducting means may be provided for allowing communication between the first compression chamber of one piston and the induction chamber of the other piston. The intermediate ducting means may extend through the centre housing. It may comprise one or more passages extending between the first compression chamber and the induction chamber of the other piston.

Suitably the combined volume of each pair of first and second compression chambers is such that it exceeds the volume of each of the combustion chambers in order to supercharge the engine. For this purpose, it is preferred that the ratio of the combined volumes of the two compression chambers to that of the combustion chambers is at least 1.2.

Each of the induction chambers is suitably provided with a supply duct for supplying combustible gas being a mixture of air and fuel to each induction chamber. The transfer of combustible gas may be regulated by a valve. The valve may be a one-way valve. It may be a reed valve. It may operate by allowing combustible gas to enter the induction chamber under suction. However, it may close when the pressure in the induction chamber exceeds atmospheric pressure in order to allow pressure in the induction chamber to build up prior to the compressed combustible gas being discharged into the combustion chamber. The supply duct itself in combination with the induction chamber may represent a combined chamber for holding compressed combustible gas ready to be directed to the combustion chamber.

Each of the cylinder elements may be provided with a head closing off the combustion chamber. Thus the drive shaft may extend through the bore assemblies located centrally with regard to the axis of the combustion chambers and through the respective heads of the combustion chambers.

Preferred aspects of the invention will now be described with reference to the accompanying drawing.

BRIEF DESCRIPTION OF THE DRAWINGS

The FIGURE shows a cross section of a combustion engine constructed in accordance with the invention.

DETAILED DESCRIPTION OF THE DRAWING

Figure 1:
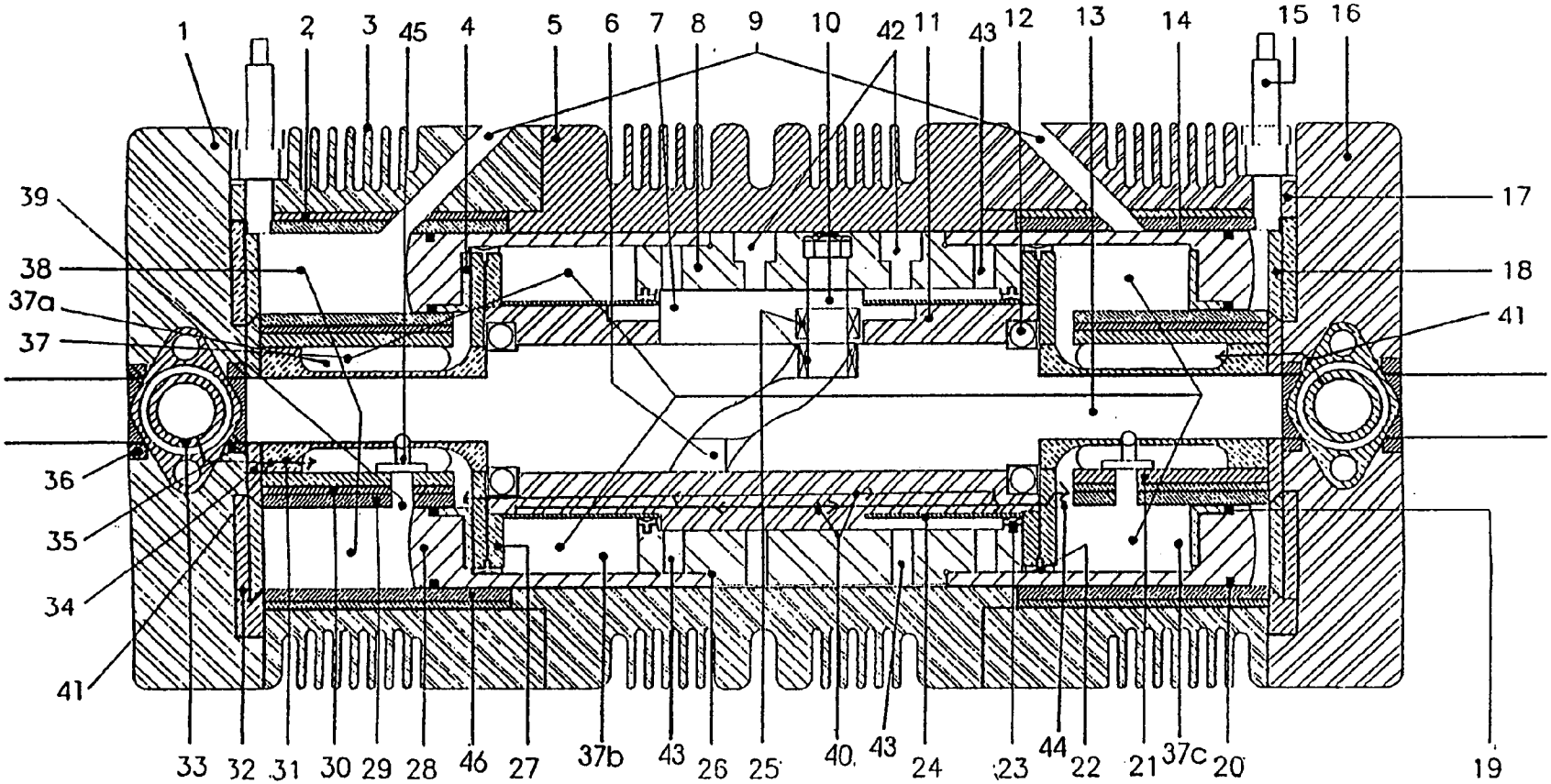

The various elements identified by numerals in the drawings are listed in the following integer list.

Integer List

1 L/H head assembly
2 Outer mica tube
3 Outer cylinder housing
4 Inner piston ring retainer
5 Outer centre housing
6 Drive groove
7 Guide plates
8 Split housing
9 Exhaust ports
10 Drive pin assembly
11 Inner centre housing
12 Main bearings
13 Drive shaft
14 Outer ceramic tube
15 Spark plugs
16 R/H head assembly
17 Head ceramic retainer
18 Head ceramic insert
19 Inner piston rings
20 Outer piston rings
21 Front barrels
22 Inner piston seal
23 Split housing seal
24 Guide plate retainer
25 Drive pin bearings
26 "O" ring seal
27 Inner piston seal retainer
28 Piston
29 Inner ceramic tube
30 Inner mica tube
31 Inlet port spacer tube
32 Head mica ring
33 Inlet port
34 Inner head mica retainer
35 Shaft seal
36 Shaft bearing
37 Induction/compression chambers
37*a* Induction chamber
37*b* Second induction/compression chamber
37*c* First induction/compression chamber
38 Combustion chamber
39 Transfer port
40 Intermediate ducting
41 Supply duct
42 Bolt hole
43 Dowel hole
44 Transfer port
45 Valve
46 Outer ceramic tube Referring to the FIGURE, the combustion engine described therein comprises two assemblies of pistons within two opposed cylinder elements. As both of these assemblies are mirror images of each other, reference to one component for one of the assemblies should be interpreted as implying an equivalent component in the other of the assemblies as well.

The combustion engine includes a left hand head assembly 1 which is fitted to an outer cylinder housing 2. An annular combustion chamber 38 is defined between the head assembly and outer cylinder housing. Both the outer cylinder housing and head assembly may be formed of any suitable material such as cast metal. For reduction of weight, it is preferred that the metal chosen be a light weight metal such as aluminium.

The outer cylinder housing is lined with two tubes, namely an outer mica tube 2 and an inner ceramic tube 46.

Each combustion chamber 38 includes a bore assembly located coaxial with the axis of the combustion chamber. The bore assembly includes an inner ceramic tube 29 surrounding an inner mica tube 30 which in turn surrounds a front barrel 21. All three components are in the form of close fitting tubular elements. They in turn surround the inlet port spacer tube 31 which in association with the front barrel 21 defines the induction chamber 37*a* comprising part of the induction/compression chamber combination formed throughout the engine as will be described hereinafter.

The head assembly closing off the combustion chamber 38 includes a head ceramic retainer 17 located in an annular recess formed in the head. The head ceramic retainer in association with the inner head mica retainer 34 acts to retain the head mica ring 32 and head ceramic insert 18 at the end of the combustion chamber.

Each of the combustion chambers is provided with a piston 28 which has an internal bore to allow it to fit around the inner ceramic tube 29. Thus the piston may slide within the combustion chamber between the confines of the inner ceramic tube 29 and the outer ceramic tube 46, so that the combustion chamber formed therebetween is annular.

Each of the pistons is provided with an outer piston ring 20 for sealing against the outer ceramic tube and an inner piston ring retainer 4 for retaining the inner piston rings 19 in sealing engagement with the inner ceramic tube 29.

Exhaust ports 9 extending through the outer cylinder housing 3, outer mica tube 2 and outer ceramic tube 46 communicate with the combustion chamber at a location immediately above the top of the piston when it is at its maximum expansion location ie. the piston is at the bottom of its stroke.

A transfer port 39 extending from the induction chamber through the bore assembly into the combustion chamber is also provided at a level immediately above the piston head when it reaches its location of maximum expansion. A valve 45 is set to open and close the transfer port. The valve is mounted on the drive shaft 13 which rotates around the axis defined by the opposed cylinders.

The valve is arranged so that it opens immediately after exhaust gas has been exhausted through the exhaust ports 9.

An outer centre housing 5 formed of the same material as the outer cylinder housing 3 is provided between the two outer cylinder housings in abutment therewith. It includes a step to retain the outer mica tube 2 and outer ceramic tube 46 in place around the combustion chamber. The inner cylindrical surface of the outer centre housing also provides a surface against which the outer skirts of each of the pistons may slide.

A first compression chamber 37*c* is defined by the annular space formed between the bore assembly, the outer ceramic tube, the inner piston seal retainer 27 holding the inner piston seal 22 and the inner piston ring retainer 4 forming the back of the piston head.

A further inlet port 44 providing communication between the induction chamber 37 and the first compression chamber 37*c* is provided at a lower part of the induction chamber than the transfer port 39.

The outer skirt of each of the pistons is attached to a split housing 8 extending between the two pistons and being joined thereto. An "O" ring seal 26 is provided at the end of the piston skirts where it abuts the split housing 8.

The split housing 8 is itself arranged to slide against the internal wall of the outer centre housing on its outer side. It also slides with respect to the inner centre housing 11 which surrounds the drive shaft 13. A number of guide plate retainers 24 are arranged around the inner centre housing providing a sealing surface for the split housing seals 23 sliding in reciprocal fashion along the guide plate retainers.

The split housing 8 includes bolt holes 42 for holding the split housing in place in association with the guide plate 7. Additional dowels fitting in the dowel holes 43 serve to hold the assembly of the split housing, guide plate and inner centre housing together within the region defined by the opposed skirts of the two pistons and the outer centre housing 5.

The drive shaft 13 which extends through the centre of the engine and through the bore assemblies includes a drive groove 6 of generally sinusoidal shape. This groove may be filled with oil for lubrication. The drive shaft may be formed of a particularly hard metal alloy such as moly steel. It may have a Rockwell hardness of about 60.

A drive pin assembly 10 fixed to the split housing and extending through a slot provided in the guide plate 7 is arranged to fit into the slot as a cam follower. The drive pin assembly 10 includes drive pin bearings 25. The arrangement is such that reciprocal movement of the pistons results in reciprocal movement of the drive pin assembly which in turn by virtue of following the drive groove rotates the drive shaft.

Main bearings 12 are provided internally at the ends of the inner centre housing around the drive shaft and further shaft bearings 36 are provided in the head assemblies 1 and 16. Shaft seals 35 are also provided in the head assemblies.

A second compression chamber 37*b* is formed between the end of the split housing 8 which includes the split housing seal 23, the guide plate retainer 24, the outer skirt of the piston and the inner piston seal retainer 27 secured around the inner centre housing 11.

Intermediate ducting 40 extending through the inner centre housing allows communication of combustible gas between the second compression chamber and the induction chamber 37*a*. The intermediate ducting may comprise holes drilled through the housing. The intermediate holes for each of the two second compression chambers 37*b* are kept separate from each other ie. they do not communicate with each other.

Combustible gases for the engine are supplied through the inlet ports 33 located in each of the head assemblies. Each inlet port 33 includes a one-way valve such as a reed valve which allows air to enter the induction chamber 37*a* via the supply duct 41 but prevents combustible gases from escaping when the combustible gases are compressed within the induction chamber.

A typical operating cycle of the engine described with reference to the FIGURE will now be described.

Starting with the piston 28 on the left hand side of the drawing, after waste combustion gases have been exhausted through the exhaust port 9, the valve 45 opens to allow compressed gases in the induction chamber 37*a* and associated supply ducting 41 to enter the combustion chamber 38. The piston 28 begins its compression stroke pushed forward by the expansion stroke of the other piston and in doing so closes off the exhaust port 9 and transfer port 39. It also moves away from covering the transfer port 44 thereby opening up the inlet port to communication with the first compression chamber 37*c*. As the piston moves upwardly, the vacuum it creates in the first and second compression chambers sucks in combustible gases. This suction operates via the inlet port 33, supply duct 41, induction chamber 37*a* and inlet port 44 and intermediate ducting 40.

When the piston approaches the top of the compression stroke, the spark plug 15 ignites the combustible mixture in the piston chamber and causes the piston to retract. By doing so, the combustible gases which have been sucked into the second compression chamber 37*c* and first compression chamber 37*b* are compressed and driven into the induction chamber 37*a* at super atmospheric pressure.

The piston is pushed downwardly and on reaching the end of its compression stroke, the combusted gases are exhausted through the exhaust port 9 and the cycle repeated indefinitely.

Thus reciprocating motion of the pistons drives the drive pin assembly 10 with a reciprocating action which is in turn converted to rotary action of the drive shaft 13 by the action of the drive pin assembly 10 and drive groove 6.

It is to be understood that the word comprising as used throughout the specification is to be interpreted in its inclusive form ie. use of the word comprising does not exclude the addition of other elements.

It is to be understood that various modifications of and/or additions to the invention can be made without departing from the basic nature of the invention. These modifications and/or additions are therefore considered to fall within the scope of the invention.

The invention claimed is:

1. A combustion engine comprising, a pair of opposed cylinder elements having a common axis, each cylinder element being provided with a piston reciprocable between first and second locations in the cylinder element the first and second locations respectively representing compression and expansion elements of the piston stroke, each piston having a forward side and a rear side, a combustion chamber for each cylinder element comprising the forward side of the piston and the walls of the cylinder element, combustible gas compression means for each combustion chamber, supply passage means arranged to deliver combustible gas to each combustion gas compression means, an induction chamber for each piston arranged to receive compressed combustible gas from the combustible gas compression means, transfer passage means for directing compressed gas from each induction chamber to the respective combustion chamber, cam means rotatable about the common axis the cam means being located between the pistons and being connected to each of the pistons for converting the reciprocating motion of the pistons into rotary motion of the cam means, the cam means comprising a cam track encircling a drive shaft aligned with the common axis, and cam follower means connected to the pistons the cam follower means being arranged to follow the cam track whereby to convert the reciprocating motion of the pistons into rotary motion of the drive shaft, wherein the arrangement is such that expansion stroke movement of each piston results in a corresponding compression stroke for the compression means and the pistons are coupled so that an expansion stroke of one of the pistons drives the compression stroke of the other of the pistons.

2. The combustion engine according to claim 1 wherein the cam track comprises a groove formed in the drive shaft.

3. The combustion engine according to claim 1 comprising a bore assembly extending through each piston and in line with the axis of each piston and the transfer passage means extend within the bore, the transfer passage means including a transfer port for each piston arranged to communicate with the combustion chamber comprising the forward side of each piston, when each piston is at or near the second location.

4. The combustion engine according to claim 3 including valve means operable by rotation of the cam means to close the transfer port during exhaustion of combusted gases from the combustion chamber and to open the transfer port after exhaustion of combusted gases from the combustion chamber.

5. The combustion engine according to claim 3 wherein the drive shaft extends into both bore assemblies and through a head for at least one of the combustion chambers.

6. The combustion engine according to claim 5 comprising a head for each combustion compression chamber, the drive shaft extending through each head.

7. The combustion engine according to claim 1 comprising an exhaust passage communicating with the combustion chamber when the piston is at or near the second location, the piston being arranged to close off the exhaust passage when it moves to the first location.

8. The combustion engine according to claim 1 comprising, an intermediate assembly extending between the pistons and connecting the rear side of each piston the intermediate assembly being slidable reciprocably along a center housing surrounding the cam means, and the combustible gas compression means comprise, a first induction/compression chamber for each piston between an end of the intermediate assembly and a piston sealing member, and a second induction/compression chamber for each piston between the forward side of the piston and the piston sealing member.

9. The combustion engine according to claim 8 comprising, intermediate ducting means for allowing communication between the first induction/compression chamber of one piston and the induction/compression chamber of the other piston.

10. The combustion engine according to claim 8 wherein the combined volume of each pair of the first and second induction compression chambers is greater than the volume of each of the combustion chambers.

11. The combustion chamber according to claim 10 wherein the combined volume is at least 1.2 times the volume of each of the combustion chambers.

12. The combustion engine according to claim 1 wherein the supply passage means comprise, a supply duct communicating with each induction/compression chamber, and valve means for allowing combustible gas to be sucked through the supply duct into the respective induction/compression chamber during an expansion stroke of the piston arranged to receive combustible gas from that induction/compression chamber.

13. A combustion engine comprising, a pair of opposed cylinder elements having a common axis, each cylinder element being provided with a piston reciprocable between first and second locations in the cylinder element the first and second locations respectively representing compression and expansion elements of the piston stroke, each piston having a forward side and a rear side, a combustion chamber for each cylinder element comprising the forward side of the piston and the walls of the cylinder element, combustible gas compression means for each combustion chamber, supply passage means arranged to deliver combustible gas to each combustion gas compression means, an induction chamber for each piston arranged to receive compressed combustible gas from the combustible gas compression means, a bore assembly extending through each piston and in line with the axis of each piston transfer passage means for directing compressed gas from each induction chamber to the respective combustion chamber, the transfer passage means extending within the bore, the transfer passage means including a transfer port for each piston arranged to communicate with the combustion chamber comprising the forward side of each piston, when each piston is at or near the second location, and cam means rotatable about the common axis the cam means being located between the pistons and being connected to each of the pistons for converting the reciprocating motion of the pistons into rotary motion of the cam means, wherein the arrangement is such that expansion stroke movement of each piston results in a corresponding compression stroke for the compression means and the pistons are coupled so that an expansion stroke of one of the pistons drives the compression stroke of the other of the pistons.

14. The combustion engine according to claim 13 including valve means operable by rotation of the cam means to close the transfer port during exhaustion of combusted gases from the combustion chamber and to open the transfer port after exhaustion of combusted gases from the combustion chamber.

15. The combustion engine according to claim 13 comprising an exhaust passage communicating with the combustion chamber when the piston is at or near the second location, the piston being arranged to close off the exhaust passage when it moves to the first location.

16. The combustion engine according to claim 13 comprising, an intermediate assembly extending between the pistons and connecting the rear side of each piston the intermediate assembly being slidable reciprocably along a center housing surrounding the cam means, and the combustible gas compression means comprise, a first induction/compression chamber for each piston between an end of the intermediate assembly and a piston sealing member, and a second induction/compression chamber for each piston between the forward side of the piston and the piston sealing member.

17. The combustion engine according to claim 16 comprising, intermediate ducting means for allowing communication between the first induction/compression chamber of one piston and the induction/compression chamber of the other piston.

18. The combustion engine according to claim 13 wherein the supply passage means comprise, a supply duct communicating with each induction/compression chamber, and valve means for allowing combustible gas to be sucked through the supply duct into the respective induction/compression chamber during an expansion stroke of the piston arranged to receive combustible gas from that induction/compression chamber.

19. The combustion engine according to claim 13 comprising a head for each combustion compression chamber, the drive shaft extending through each head and into both bore assemblies.

20. A combustion engine comprising, a pair of opposed cylinder elements having a common axis, each cylinder element being provided with a piston reciprocable between first and second locations in the cylinder element the first and second locations respectively representing compression and expansion elements of the piston stroke, each piston having a forward side and a rear side, a combustion chamber for each cylinder element comprising the forward side of the piston and the walls of the cylinder element, combustible gas compression means for each combustion chamber, the combustible gas compression means comprising a first induction/compression chamber for each piston between an end of the intermediate assembly and a piston sealing member, and a second induction/compression chamber for each piston between forward side of the piston and the piston sealing member, supply passage means arranged to deliver combustible gas to each combustion gas compression means, an induction chamber for each piston arranged to receive compressed combustible gas from the combustible gas compression means, transfer passage means for directing compressed gas from each induction 15 chamber to the respective combustion chamber, cam means rotatable about the common axis the cam means being located between the pistons and being connected to each of the pistons for convening the reciprocating motion of the pistons into rotary motion of the cam means, and an intermediate assembly extending between the pistons and connecting the rear side of each piston, the intermediate assembly being slidable reciprocably along a center housing surrounding the cam means, wherein the arrangement is such that expansion stroke movement of each piston results in a corresponding compression stroke for the compression means and the pistons are coupled so that an expansion stroke of one of the pistons drives the compression stroke of the other of the pistons.

21. The combustion engine according to claim 20 comprising, intermediate ducting means for allowing communication between the first induction/compression chamber of one piston and the induction/compression chamber of the other piston.

22. The combustion engine according to claim 20 wherein the supply passage means comprise, a supply duct communicating with each induction/compression chamber, and valve means for allowing a combustible gas to be sucked through the supply duct into the respective induction/compression chamber during an expansion stroke of the piston arranged to receive combustible gas from that induction/compression chamber.

* * * * *